US006276730B1

(12) United States Patent
Sherrill

(10) Patent No.: US 6,276,730 B1
(45) Date of Patent: Aug. 21, 2001

(54) KNOT REMOVAL DEVICE

(76) Inventor: Edna Faye Sherrill, 6338 Dupree Dr., Columbus, GA (US) 31907

( * ) Notice: Subject to any disclaimer, the term of this patent is extended or adjusted under 35 U.S.C. 154(b) by 0 days.

(21) Appl. No.: 09/602,041

(22) Filed: Jun. 23, 2000

(51) Int. Cl.[7] ..... D03J 3/00
(52) U.S. Cl. ..... 289/17; 289/1.5
(58) Field of Search ..... 289/1.2, 1.5, 16.5, 289/17, 18.1

(56) References Cited

U.S. PATENT DOCUMENTS

| | | | | |
|---|---|---|---|---|
| D. 280,463 | | 9/1985 | Sheahan . | |
| D. 375,997 | | 11/1996 | Tipp . | |
| 1,210,845 | | 1/1917 | Roth . | |
| 3,284,865 | | 11/1966 | Burnham . | |
| 3,709,536 | * | 1/1973 | Huber | 289/1.5 |
| 3,970,338 | * | 7/1976 | Crowe | 289/1.5 |
| 4,008,913 | * | 2/1977 | Cole | 289/17 |
| 4,525,003 | * | 6/1985 | Tate, Jr. | 289/17 |
| 4,691,465 | | 9/1987 | Dooley . | |
| 4,714,281 | * | 12/1987 | Peck | 289/1.5 |
| 4,790,575 | * | 12/1988 | Tate | 289/17 |
| 5,122,152 | | 6/1992 | Mull . | |
| 5,405,352 | * | 4/1995 | Weston | 606/148 |
| 5,927,764 | * | 7/1999 | Harriman | 289/17 |

* cited by examiner

*Primary Examiner*—John J. Calvert
*Assistant Examiner*—Gary L. Welch

(57) ABSTRACT

A knot removal device for removing knots. The knot removal device includes a plate. The plate has a facing side, a back side, a top edge, a bottom edge and a pair of side edges. A rod is elongate and has a first end and a second end. The first end is integrally coupled to the top edge such that the rod extends upwardly away from the top edge. The rod has a bend therein. The bend is positioned nearer the second end such that the second end defines a hook portion.

11 Claims, 3 Drawing Sheets

KNOT REMOVAL DEVICE

BACKGROUND OF THE INVENTION

1. Field of the Invention

The present invention relates to knot removing utensils and more particularly pertains to a new knot removal device for removing knots.

2. Description of the Prior Art

The use of knot removing utensils is known in the prior art. More specifically, knot removing utensils heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,284,865; U.S. Pat. No. 4,691,465; U.S. Pat. No. 5,122,152; U.S. Pat. No. 375,997; U.S. Des. Pat. No. 280,463; and U.S. Pat. No. 1,210,845.

While these devices fulfill their respective, particular objectives and requirements, the aforementioned patents do not disclose a new knot removal device. The inventive device includes a plate. The plate has a facing side, a back side, a top edge, a bottom edge and a pair of side edges. A rod is elongate and has a first end and a second end. The first end is integrally coupled to the top edge such that the rod extends upwardly away from the top edge. The rod has a bend therein. The bend is positioned nearer the second end such that the second end defines a hook portion.

In these respects, the knot removal device according to the present invention substantially departs from the conventional concepts and designs of the prior art, and in so doing provides an apparatus primarily developed for the purpose of removing knots.

SUMMARY OF THE INVENTION

In view of the foregoing disadvantages inherent in the known types of knot removing utensils now present in the prior art, the present invention provides a new knot removal device construction wherein the same can be utilized for removing knots.

The general purpose of the present invention, which will be described subsequently in greater detail, is to provide a new knot removal device apparatus and method which has many of the advantages of the knot removing utensils mentioned heretofore and many novel features that result in a new knot removal device which is not anticipated, rendered obvious, suggested, or even implied by any of the prior art knot removing utensils, either alone or in any combination thereof.

To attain this, the present invention generally comprises a plate. The plate has a facing side, a back side, a top edge, a bottom edge and a pair of side edges. A rod is elongate and has a first end and a second end. The first end is integrally coupled to the top edge such that the rod extends upwardly away from the top edge. The rod has a bend therein. The bend is positioned nearer the second end such that the second end defines a hook portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knot removal device apparatus and method which has many of the advantages of the knot removing utensils mentioned heretofore and many novel features that result in a new knot removal device which is not anticipated, rendered obvious, suggested, or even implied by any of the prior art knot removing utensils, either alone or in any combination thereof.

It is another object of the present invention to provide a new knot removal device which may be easily and efficiently manufactured and marketed.

It is a further object of the present invention to provide a new knot removal device which is of a durable and reliable construction.

An even further object of the present invention is to provide a new knot removal device which is susceptible of a low cost of manufacture with regard to both materials and labor, and which accordingly is then susceptible of low prices of sale to the consuming public, thereby making such knot removal device economically available to the buying public.

Still yet another object of the present invention is to provide a new knot removal device which provides in the apparatuses and methods of the prior art some of the advantages thereof, while simultaneously overcoming some of the disadvantages normally associated therewith.

Still another object of the present invention is to provide a new knot removal device for removing knots.

Yet another object of the present invention is to provide a new knot removal device which includes a plate. The plate has a facing side, a back side, a top edge, a bottom edge and a pair of side edges. A rod is elongate and has a first end and a second end. The first end is integrally coupled to the top edge such that the rod extends upwardly away from the top edge. The rod has a bend therein. The bend is positioned nearer the second end such that the second end defines a hook portion.

Still yet another object of the present invention is to provide a new knot removal device that has a hook portion thereon for placement between two abutting portions of shoelace for pulling the portions apart to remove a knot.

Even still another object of the present invention is to provide a new knot removal device that may be used as a shoehorn.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
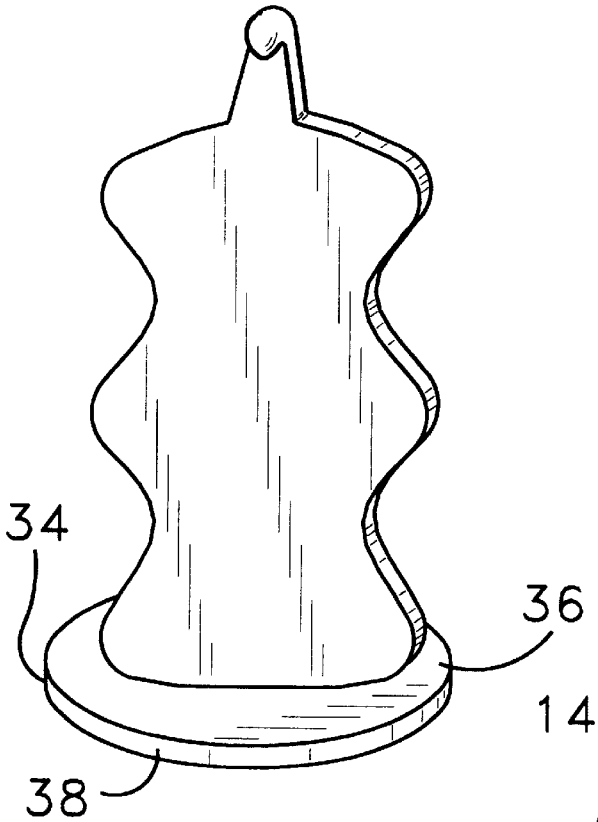
FIG. 2 is a schematic perspective view of the second embodiment of the present invention.
Figure 1:
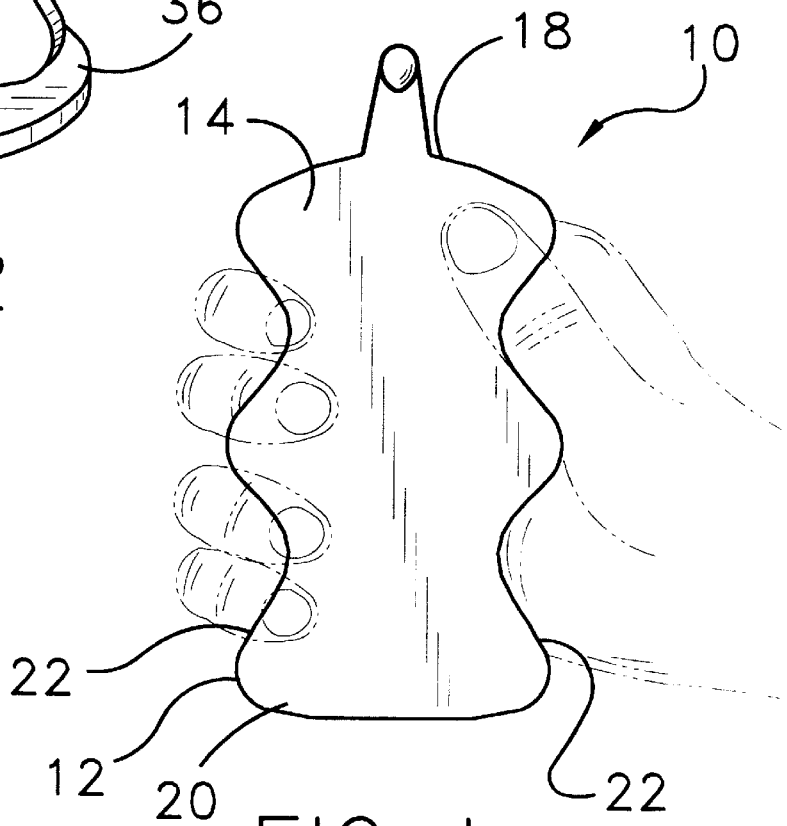
FIG. 1 is a schematic front view of a new knot removal device according to the present invention.

With reference now to the drawings, and in particular to FIGS. 1 through 6 thereof, a new knot removal device embodying the principles and concepts of the present invention and generally designated by the reference numeral 10 will be described.

As best illustrated in FIGS. 1 through 6, the knot removal device 10 generally comprises a plate 12. The plate 12 has a facing side 14, a back side 16, a top edge 18, a bottom edge 20 and a pair of side edges 22. Each of the side edges 22 preferably has a pair of spaced indents 24 therein. The indents 24 are preferably rounded. The plate 12 preferably comprises a substantially rigid material such as a plastic material or a metal.

A rod 26 is elongate and has a first end 28 and a second end 30. The first end 28 is integrally coupled to the top edge 18 such that the rod 26 extends upwardly away from the top edge 18. The rod 26 has a bend 32 therein. The bend 32 is positioned nearer the second end 30 such that the second end 30 defines a hook portion. The rod 26 preferably has a width less than ½ inches.

In the second embodiment, shown in FIG. 2, a support wall 34 has a generally planar top surface 36 and a generally planar bottom surface, not shown. The bottom edge 20 of the plate 12 is integrally coupled to the top surface 36. The support wall 34 is orientated generally perpendicular to the plate 12 and preferably has a rounded peripheral edge 38.

Figure 4:
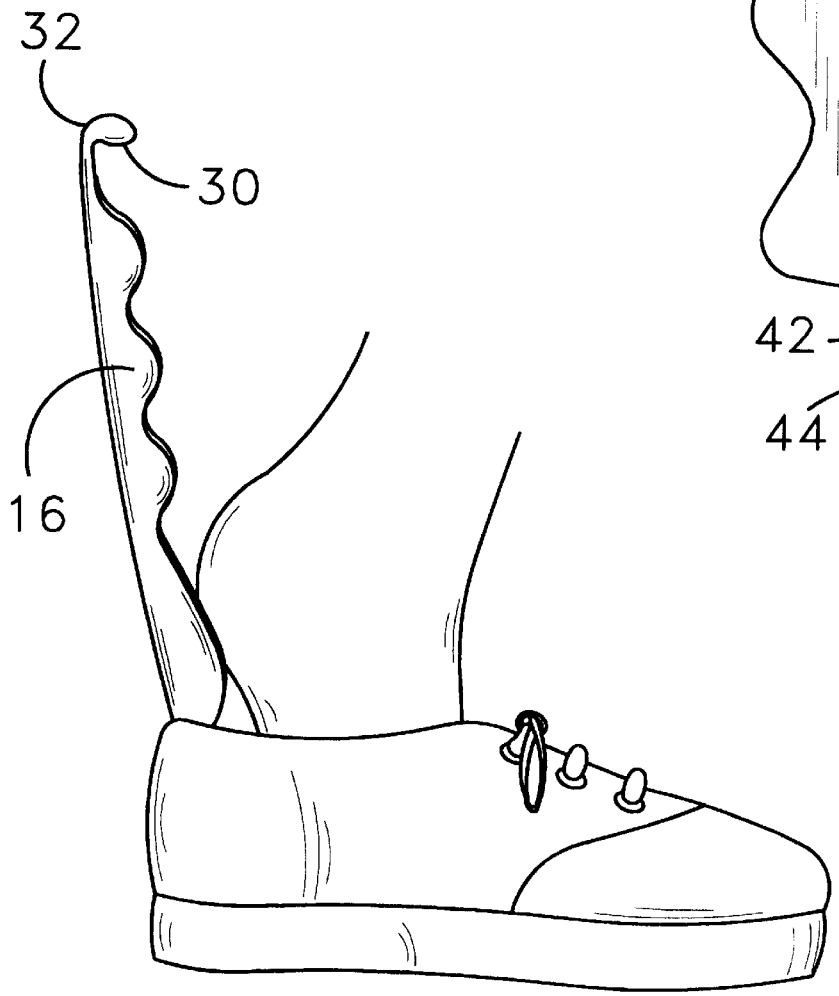
FIG. 4 is a schematic side view the third embodiment of the present invention.

In the third embodiment, shown in FIG. 4, the plate 12 also acts a shoehorn. The plate is bent along a line extending between the top 18 and bottom 20 edges such that the facing side 14 of the plate is generally concave.

Figure 3:
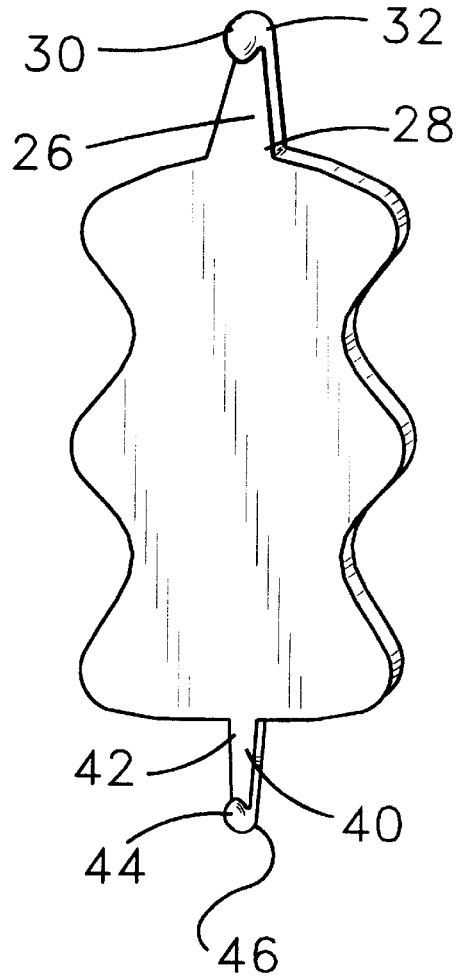
FIG. 3 is a schematic perspective view of the fourth embodiment of the present invention.
Figure 5:
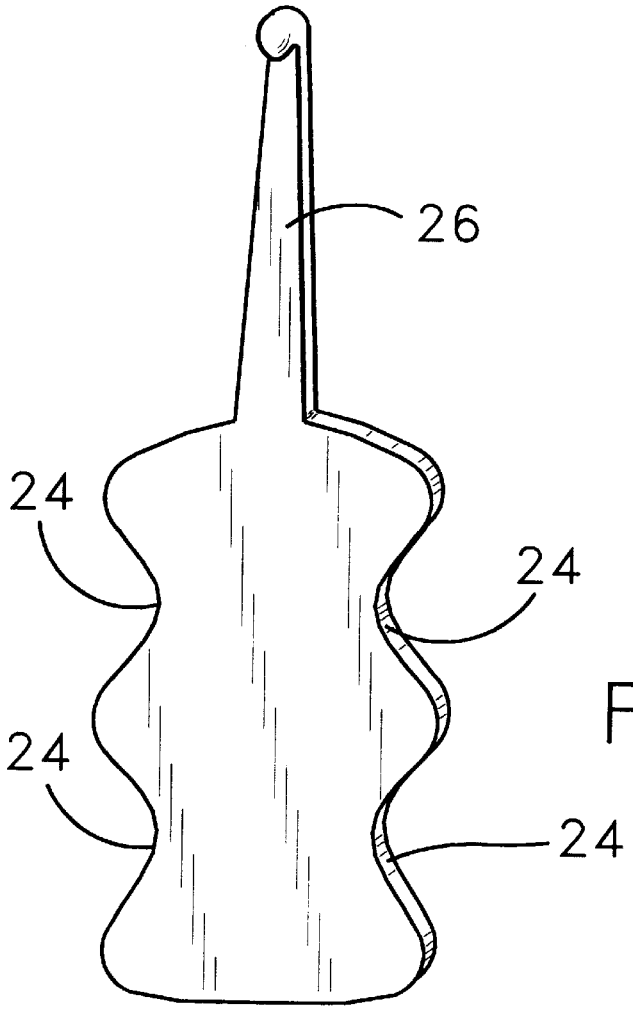
FIG. 5 is a schematic perspective view of the present invention.
Figure 6:
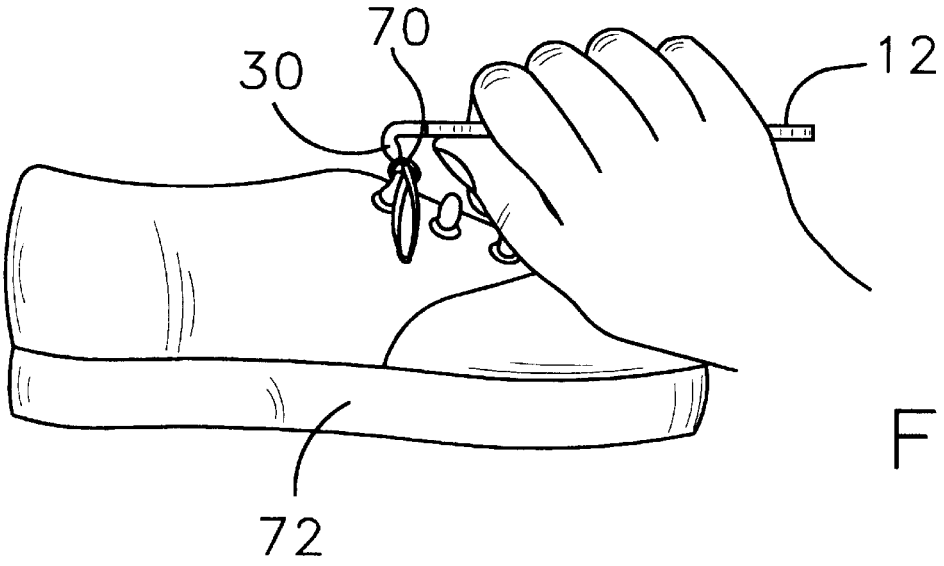
FIG. 6 is a schematic side in use view of the present invention.

In the fourth embodiment, shown in FIG. 3, a second rod 40 is coupled to the plate 12. The second rod 40 is elongate and has a first end 42 and a second end 44. The first end 42 is integrally coupled to the bottom edge 20 such that the second rod 40 extends downwardly away from the bottom edge 20. The second rod 40 has a bend 46 therein. The bend 46 is positioned nearer the second end 44 such that the second end 44 defines a hook portion. The second rod 40 preferably has a width less than ¼ inches and is made for smaller knots. FIG. 5 shows another version of the first embodiment having a longer rod 26. The second ends 30, 44 of the rods are preferably rounded or pointed.

In use, a user uses the hook portion for removing knots 70 from shoelaces in shoes 72. The device 10 may also be used for knots found in jewelry and the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knot removing device for removing knots from shoe laces, said device comprising:

a plate having a facing side, a back side, a top edge, a bottom edge and a pair of side edges;

a rod being elongate and having a first end and a second end, said first end being integrally coupled to said top edge such that said rod extends upwardly away from said top edge, said rod having a bend therein, said bend being positioned nearer said second end such that said second end defines a hook portion;

wherein said plate is bent along a line extending between said top and bottom edges such that said facing side of said plate is generally concave; and wherein each of said side edges of said plate has a pair of spaced indents therein.

2. The knot removing device as in claim 1, further comprising:

a support wall having a generally planar top surface and a generally planar bottom surface, said bottom edge of said plate being integrally coupled to said top surface, said support wall being orientated generally perpendicular to said plate.

3. The knot removing device as in claim 1, wherein each of said side edges of said plate has a pair of spaced indents therein.

4. The knot removing device as in claim 1, wherein said rod has a width less than ½ inches.

5. The knot removing device as in claim 1, further comprising:

a second rod being elongate and having a first end and a second end, said first end being integrally coupled to said bottom edge such that said second rod extends downwardly away from said bottom edge, said second rod having a bend therein, said bend being positioned nearer said second end such that said second end defines a hook portion, said second rod having a width less than ¼ inches.

6. A knot removing device for removing knots from shoe laces, said device comprising:

a plate having a facing side, a back side, a top edge, a bottom edge and a pair of side edges, each of said side edges having a pair of spaced indents therein, said indents being rounded, each of the indents on one of said side edges being positioned in a transversely opposed location to one of the indents on the other of said side edges, said plate comprising a substantially rigid material;

a rod being elongate and having a first end and a second end, said first end being integrally coupled to said top edge such that said rod extends upwardly away from said top edge, said rod having a bend therein, said bend being positioned nearer said second end such that said second end defines a hook portion, said rod having a width less than ½ inches.

7. A knot removing device for removing knots, comprising:

a plate portion having a facing side, a back side, a top edge, a bottom edge and a pair of side edges;

an elongate first rod portion having a first end and a second end, said first end being mounted on said top edge and extending away from said top edge, said first rod portion having a bend therein, said bend being positioned relatively nearer said second end such that said second end defines a hook portion;

an elongate second rod portion having a first end and a second end, said first end being mounted on said bottom edge and extending away from said bottom edge in a direction opposite on said first rod portion, said second rod portion having a bend therein, said bend being positioned relatively nearer said second end such that said second end defines a hook portion.

8. The knot removing device as in claim 7, wherein said plate is bent along a line extending between said top and bottom edges such that said facing side of said plate is generally concave.

9. The knot removing device as in claim 7, wherein each of said side edges of said plate has a pair of spaced indents therein.

10. The knot removing device as in claim 7, wherein each of said rod portions has a width less than ½ inches.

11. The knot removing device as in claim 7, wherein each of said side edges of said plate has a pair of spaced indents therein.

* * * * *